US006295426B1

(12) United States Patent
Yoshino et al.

(10) Patent No.: US 6,295,426 B1
(45) **Date of Patent: *Sep. 25, 2001**

(54) TONER CARTRIDGE

(75) Inventors: Masahiro Yoshino; Hiroshi Yamazaki, both of Hachioji (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/766,971

(22) Filed: Dec. 16, 1996

(30) Foreign Application Priority Data

Dec. 25, 1995 (JP) ..... 7-337000

(51) Int. Cl.[7] ..... G03G 15/08

(52) U.S. Cl. ..... 399/106; 222/DIG. 1; 399/262; 399/263; 264/523; 428/35.7

(58) Field of Search ..... 428/35.7; 264/523; 399/106, 262, 263; 222/DIG. 1

(56) References Cited

U.S. PATENT DOCUMENTS

| | | | | |
|---|---|---|---|---|
| 4,038,042 | * | 7/1977 | Adelman | 264/129 |
| 4,547,541 | * | 10/1985 | Golba, Jr. | 264/349 |
| 5,101,871 | * | 4/1992 | Susumu | 141/364 |
| 5,221,782 | * | 6/1993 | Aida et al. | 524/451 |

* cited by examiner

*Primary Examiner*—Judy M. Reddick
(74) *Attorney, Agent, or Firm*—Jordan B. Bierman; Bierman, Muserlian and Lucas

(57) ABSTRACT

Disclosed is a toner cartridge comprising: a container body for storing toner, said container body having an opening through which said toner is discharged, wherein said container body is made of a resin having an Izod impact value of 0.1 to 30, and a melt flow index of 0.1 to 30 g/10 min.

14 Claims, 7 Drawing Sheets

TONER CARTRIDGE

FIELD OF THE INVENTION

The present invention relates to an improvement in cartridge used for containing and filling powdery toner used in electrophotography and, for example, it relates to an improvement in a toner cartridge, which is fixed freely attachable to and removable from electrostatic image-forming apparatuses such as electrophotographic copying machines or laser printers.

BACKGROUND OF THE INVENTION

Heretofore, as a means for supplying powder which easily scatters in the air, into a powder receiving apparatus, a powder is contained in the container and the open portion thereof, from which the powder is to be taken out, is sealed with a film sealer has been used. Upon supplying the powder, turn the above-mentioned powder container upside down and, thus to fix the mouth to the applying portion of the powder receiving apparatus, and the powder is supplied into a hopper of the powder receiving apparatus. Such powder container as mentioned above has been used more popularly, than containers, in which the opening mouth portion is sealed with a lid, because structure of the opening portion can be made simple, and sealing can be performed more thoroughly.

In electrostatic image-forming apparatuses, an electrostatic latent image formed on rotating electrostatic charge carrier is developed using a developing unit and after toner particles present in a developer are made attached to the electrostatic latent image portion, thus to form a toner image, this is transferred and then fixed on a recording paper. Since the above-mentioned powdery toner is consumed with development, it is necessary to supply the toner to the development unit according to consumption and as a reservoir portion for supplying toner, a toner hopper is provided.

Large quantity of toner is stored in the toner hopper and, before this is used up, the toner is supplied from the toner cartridge to the above-mentioned toner hopper.

The above-mentioned represents a toner supply in an electrostatic recording apparatus using so-called a dry two-component developer, and similar toner supply is also necessary concerning electrostatic image-forming apparatus using so-called a one component developer.

In either case of the above-mentioned developers, supply of toner is carried out by putting toner from a toner cartridge, in which toner is stored, into the toner hopper.

In the toner supplying, since the above-mentioned powdery toner can easily scatter and float outside into the air from the open portion in the toner cartridge or in the toner hopper so as to contaminate the apparatus, the air or clothes, lots of proposals have been made in order to avoid these problems.

Among these proposals, for example, there are toner cartridges proposed in Japanese Utility Model O.P.I. Publication No. 59-114572/1984 and Japanese patent O.P.I. Publication No. 3-279983(1991). This toner cartridge comprises a container body, a fixed cap which corks up the upper portion of the container body, a mouthpiece portion which connects to the bottom portion of the container body, a film sealing member, which allows the opening at the bottom of the container body to peel apart and a slidable lid which is capable of being slidably engaged with the above-mentioned mouth piece while winding up said film realing member.

The toner cartridge is mounted on the developer receiving device of an electrostatic image forming apparatus such as copying machines, and then, a slidable lid is moved to a direction. Next, a sealing member of a supplying port is pulled to open the supplying part, and the toner drops from the supplying part, so as to supply the toner into the toner hopper.

Function required to the toner cartridge in itself is to store toner to be filled up inside. It is an important element for the toner storing to prevent a damage of the toner cartridge during transportation.

As for materials which have conventionally been used in the art for this purpose, for example, resins such as polystyrene(PS), styrene-butadiene (ABS), etc. can be mentioned. Further, polyethylene (PE), polypropylene (PP) have also been employed.

Among the above-mentioned resins, resins such as polystyrene and styrene-butadiene, etc., do not have sufficient resistance to impact such as falling impact, and, when the cartridge is broken, an accident that toner contained in the cartridge is leaked out of the cartridge and scattered into the air generates. Moreover, these resins can hardly be re-generated. Further although those resins such as polyethylene or polypropylene, which have heretofore been generally used, re-generation is possible, they are inferior in fabrication adaptability and, especially, due to its poor melt flow property, they were not suitable for blow molding process.

The present invention has been made for the purpose of solving the above-mentioned problem and the object of the present invention is, accordingly, to provide a toner cartridge which has excellent durability, good resistance to impact by dropping, excellent adaptability to resin mold processing and excellent regeneration property.

SUMMARY OF THE INVENTION

The toner cartridge of the present invention which can achieve the above-mentioned object can be attained by the following items.

Item 1. A toner cartridge comprising:

a container body for storing toner, said container body having an opening through which said toner is discharged, wherein said container body is made of a resin having an Izod impact value of 0.1 to 30, and a melt flow index of 0.1 to 30 g/10 min.

Item 2. The toner cartridge of item 1, wherein said resin is polypropylene or polyethylene.

Item 3. The toner cartridge of item 2, wherein said resin is polypropylene.

Item 4. The toner cartridge of item 2, wherein said resin is polyethylene.

Item 5. The toner cartridge of item 1, wherein said resin has an Izod impact value of 0.1 to 30, and a melt flow index of 1 to 30 g/10 min.

Item 6. The toner cartridge of item 1, wherein said resin has an Izod impact value of 0.1 to 30, and a melt flow index of 0.1 to 4 g/10 min.

Item 7. The toner cartridge of item 5, wherein said container body is formed by injection molding method.

Item 8. The toner cartridge of item 6, wherein said container body is formed by hollow blow molding method.

Item 9. The toner cartridge of item 5, wherein said resin is polypropylene or polyethylene.

Item 10. The toner cartridge of item 6, wherein said resin is polypropylene or polyethylene.

Item 11. The toner cartridge of item 9, wherein said resin is polyethylene having a density of 0.94 to 0.97 or polypropylene having a density of 0.90 to 0.91.

Item 12. The toner cartridge of item 10, wherein said resin is polyethylene having a density of 0.94 to 0.97 or polypropylene having a density of 0.90 to 0.91.

Item 13. The toner cartridge of item 1, wherein said container body is composed of a casing and a mouthpiece, and said casing and said mouthpiece are formed integrally by injection molding method.

Item 14. The toner cartridge of item 7, wherein said toner cartridge further comprises a mouthpiece provided on said opening of said container body, said mouth piece is made of one resin selected from polypropylene and polyethylene, said resin having an Izod impact value of 0.1 to 30, and a melt flow index of 0.1 to 4 g/10 min, and said mouthpiece is formed by hollow blow molding method.

A perspective view showing the first embodiment of the toner cartridge of the present invention.

[FIG. 2]

An cross sectional view of the above-mentioned toner cartridge of the present invention.

[FIG. 3]

A perspective view showing the container body of the above-mentioned toner cartridge of the present invention.

Figure 4:
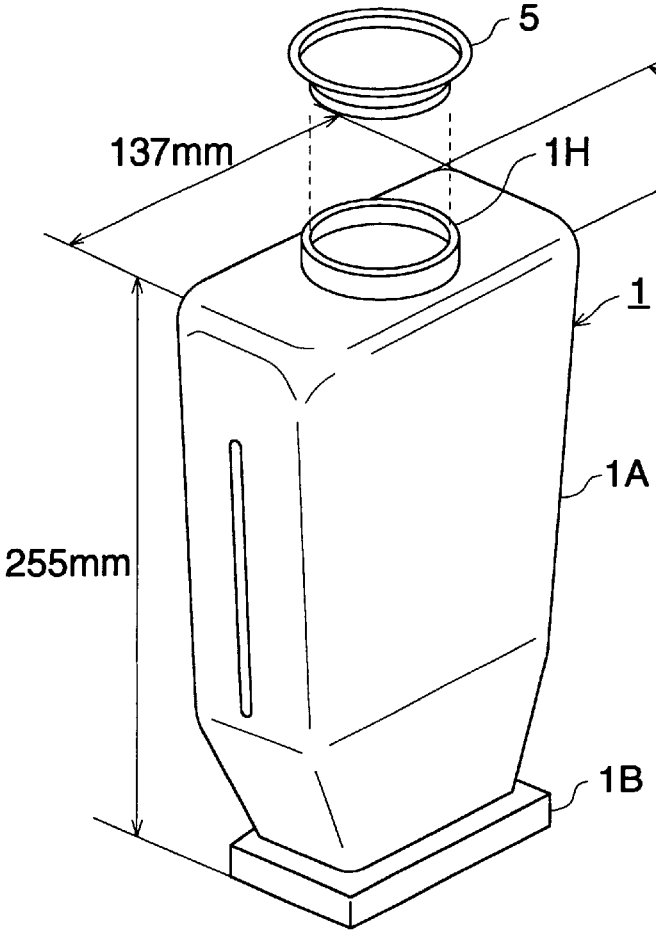
Figure 4:
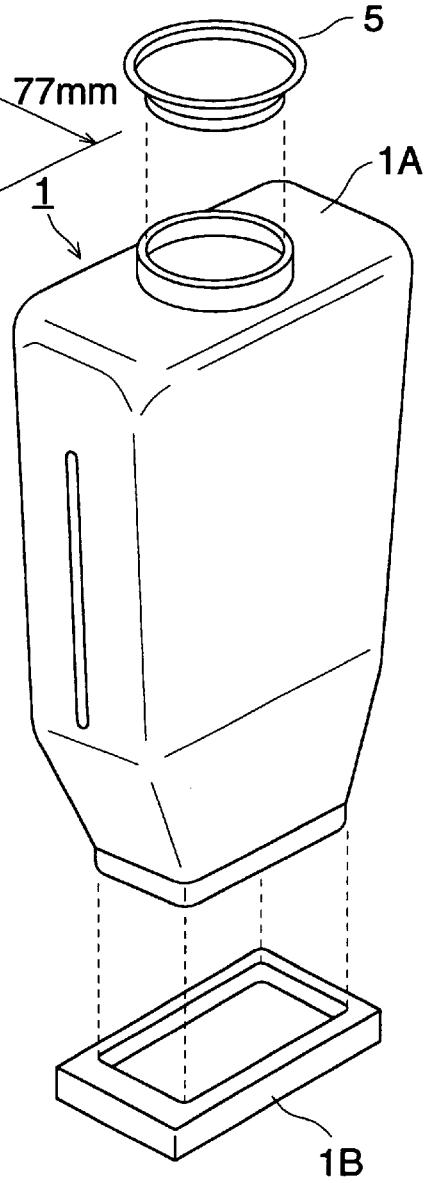

[FIGS. 4(*a*) and 4(*b*)]

A perspective view showing the second embodiment of the toner cartridge of the present invention.

[FIG. 5]

A cross sectional view of the container body of the above-mentioned toner cartridge.

Figure 6:
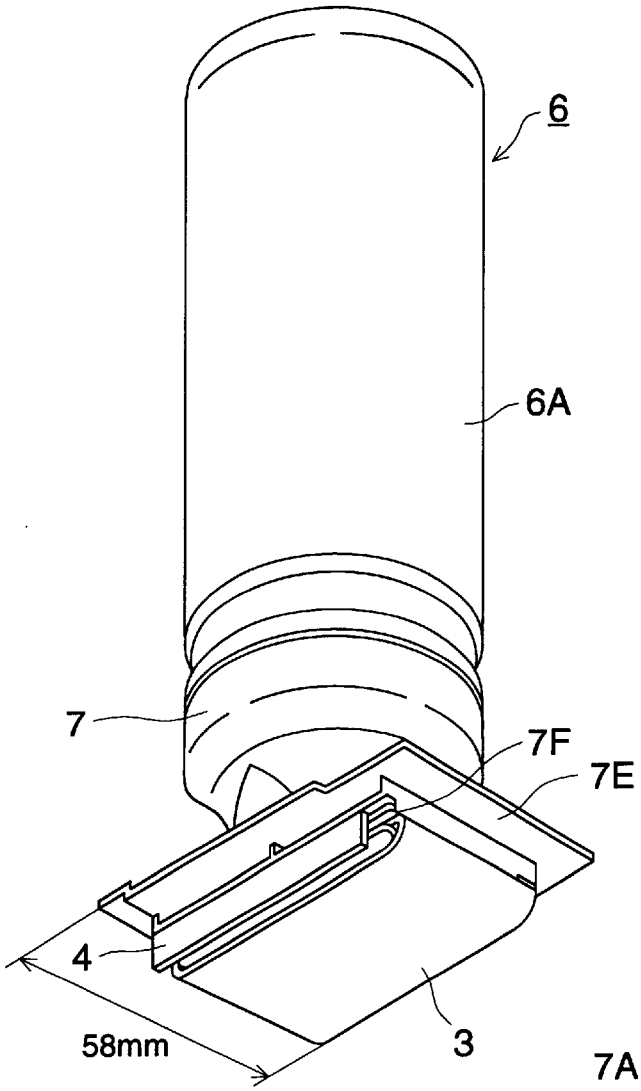
Figure 6:
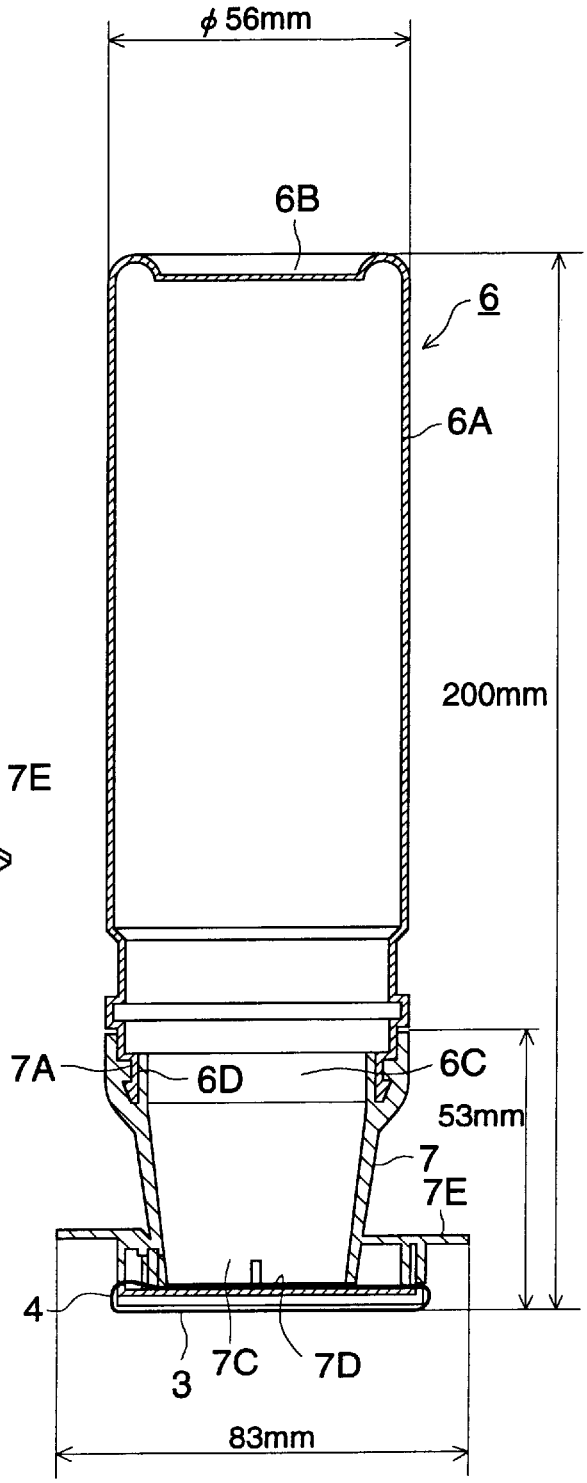

[FIGS. 6(*a*) and 6(*b*)]

A perspective and a cross sectional view showing the third embodiment of the toner cartridge of the present invention.

[FIG. 7]

An oblique view of the above-mentioned toner cartridge.

EXPLANATION OF SYMBOLS

1 and 6: Container Body

1A and 6A: Casing

1B: Mouthpiece

1C and 6C and 7C: Toner replenishing port rection

2 and 5: Capping Member

3: Flexible Sealing Member

4: Slidable Lid

Connecting Section

7: Mouthpiece Member

7A: Connection Receiving Member

DETAILED DESCRIPTION OF THE INVENTION

There are two methods for constructing the container body using a resin. One is injection molding method and the other is hollow blow molding method. As for resins to be used in these methods, polypropylene or polyethylene may be mentioned, however, every material may not necessarily be applicable to either method and, particularly, in the case where it is used for the toner supplying container, using resins having properties recited in the following items A to D, damages due to impact applied during transportation or during actual use are prevented.

Especially, in the case where the cartridge is manufactured by injection molding method, the toner cartridge of item A or item B is preferably employed. When the cartridge is manufactured by hollow blow molding method, the toner cartridge described in items C or D is preferably employed.

(A) A toner cartridge comprising;

a container body for storing toner, said container body having an opening through which said toner is discharged, wherein, said container body is made of polypropylene having the Izod impact value of 0.1 to 30 and a melt flow index of 1 to 30 g/10 min.

(B) A toner cartridge comprising;

a container body for storing toner, said container body having an opening through which said toner is discharged, wherein, said container body is made of polyethylene having Izod impact value of 0.1 to 30, a melt flow index of 1 to 30 g/10 min. and a density of 0.94 to 0.97.

(C) A toner cartridge comprising:

a container body for storing toner, said container body having an opening through which said toner is discharged, wherein, said container body is made of polypropylene having Izod impact value of 0.1 to 30, a melt flow index of 0.1 to 4 g/10 min.

(D) A toner cartridge comprising;

a container body for storing toner, said container body having an opening through which said toner is discharged, wherein, said container body is made of polyethylene having Izod impact value of 0.1 to 30, a melt flow index of 0.1 to 4 g/10 min. and a density of 0.94 to 0.97.

The reason is that, since the injection molding method is a method of injecting a resin into clearance of a mold, appropriate flowing property is required. Therefore, as for, the resin which constitutes the container body, polypropylene having the melt-flow index value of 1 to 30 g/10 min. or polyethylene having the melt-flow index of 1–30 g/10 min. and density of 0.94 to 0.97 are preferably employed.

When the melt-flow index is less than this range, flowing property tends to be insufficient and the resin tends to be mold unevenly, so that the outer wall of the container body tends to be uneven, and strength tends to be insufficient.

When, on the other hand, the melt-flow index is more than this range, the resin flows easily, and thus, evenness is improved, however, thermal stability tends to be decrease and durability tends to deteriorate.

Further, in the hollow blow molding method, in which a resin is poured into a metallic mold, compressed air is blown into the resin in the mold in order that the resin adheres the mold and, then cooled and solidified to form into a predetermined shape. In this method, excellent results of the present invention are obtained when polypropylene having melt flow index of 0.1–4 g/10 min. or polyethylene having melt flow index of 0.1–4 g/10 min. and density of 0.94–0.97 is used.

Resin with a low melt flow index, has poor flowing property and, uniform blow molding tends to be difficult in the step of blowing up with the compressed air and, as a result, the outer wall of the container body tends to be uneven, and thus, the durability of the container body against impact tends to be decrease.

Further, when the melt flow index is high and resin has an excessive flowing property, the resin flow tends to be unstable, and, particularly, as the resin tends to accumulate in the bottom portion of the mold, and thus, the thickness of the outer wall of the container tends to vary between the upper portion and the lower portion thereof, and the durability of the entire container tends to decrease.

Herein, when impact is applied in order for the container not to be broken, it must have a certain izot impact value. Specifically it is preferable that the Izod impact value is 0.1 to 30. When this izot impact value is small, the container is easily broken by impact. When this Izod impact value is 0.1 to 30, the container shows excellent durability against practical impact.

Below, embodiments of the toner cartridge according to the present invention are explained with reference to drawings.

Figure 1:
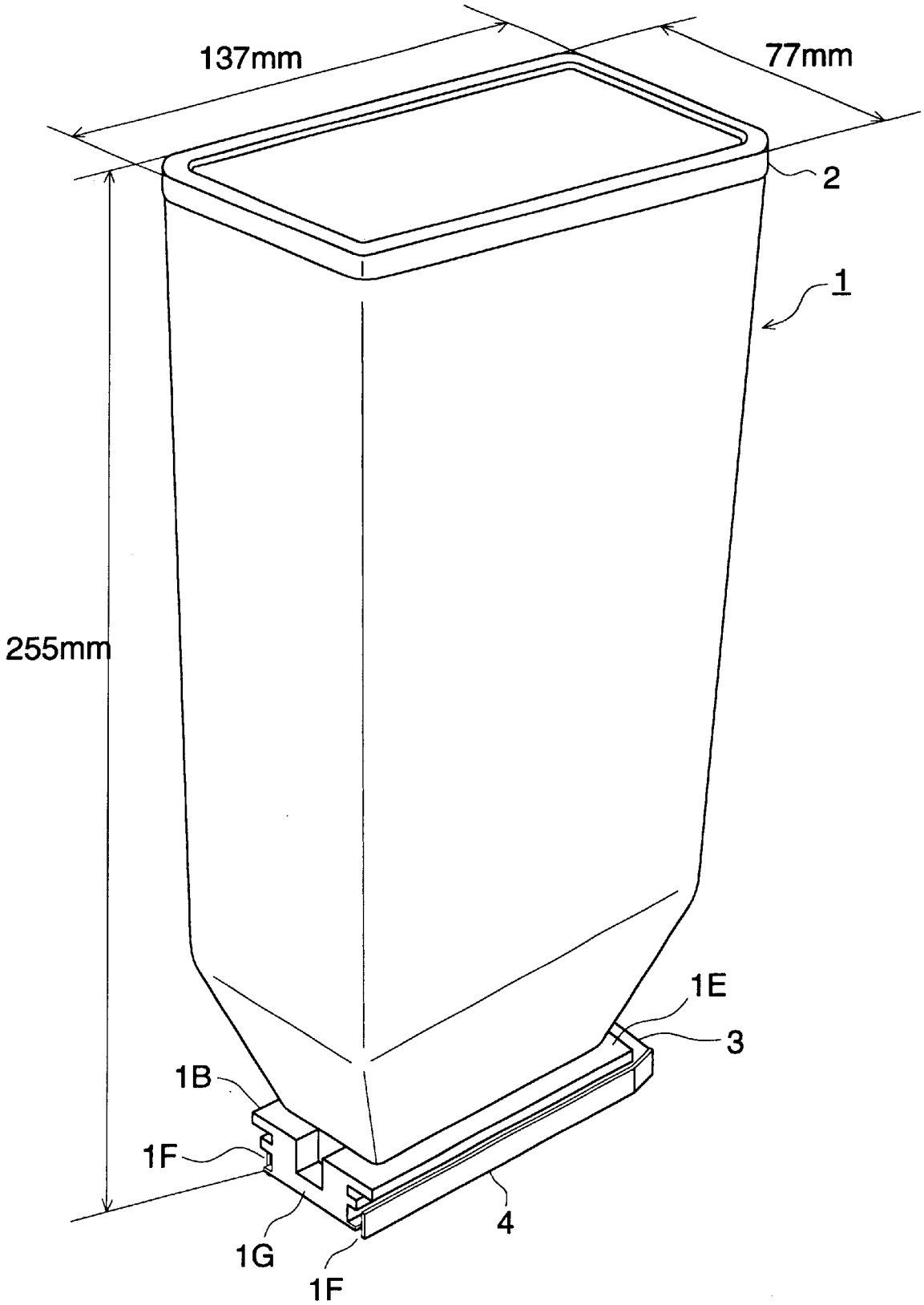
[FIG. 1]
Figure 2:
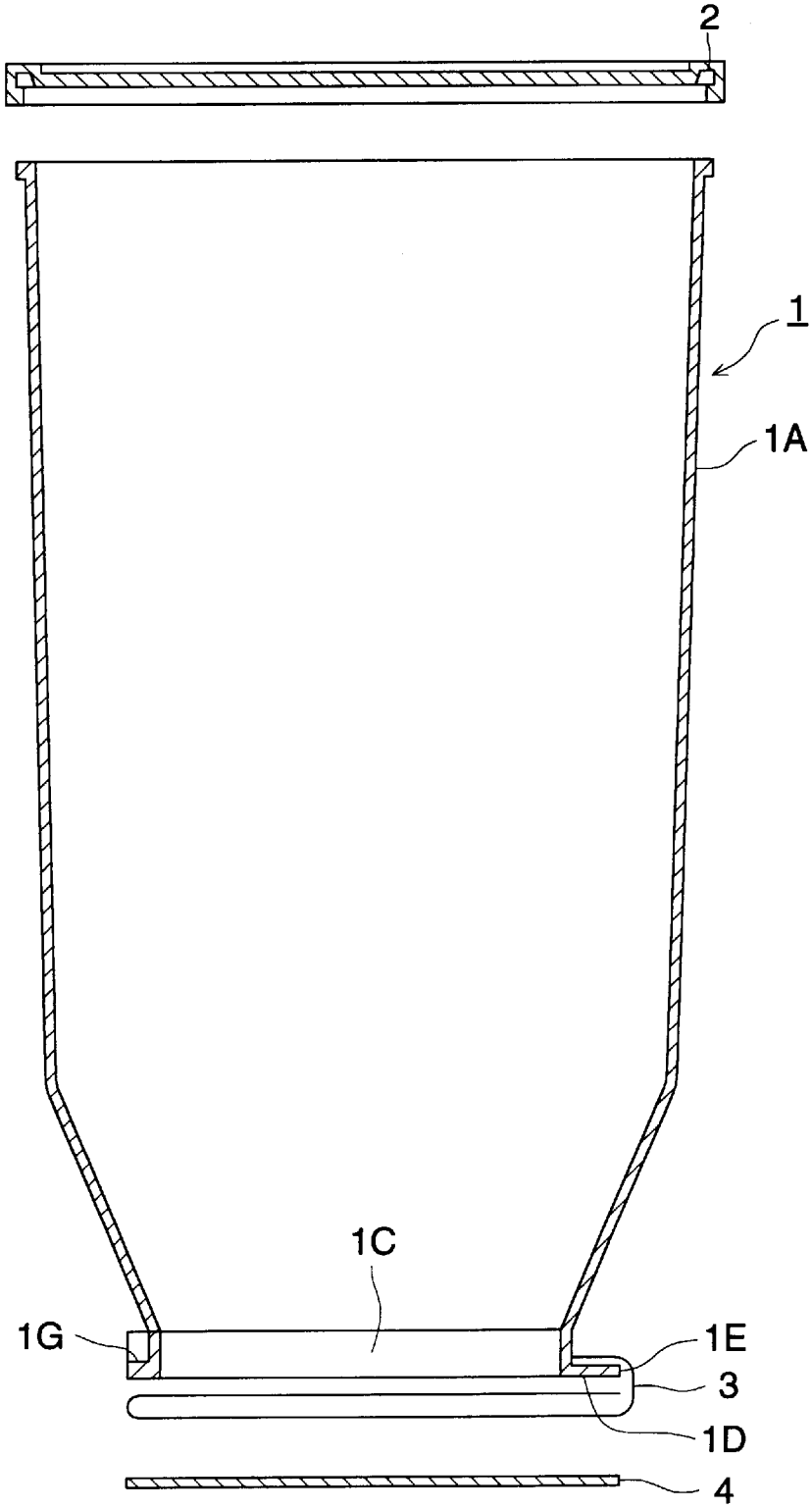
Figure 3:
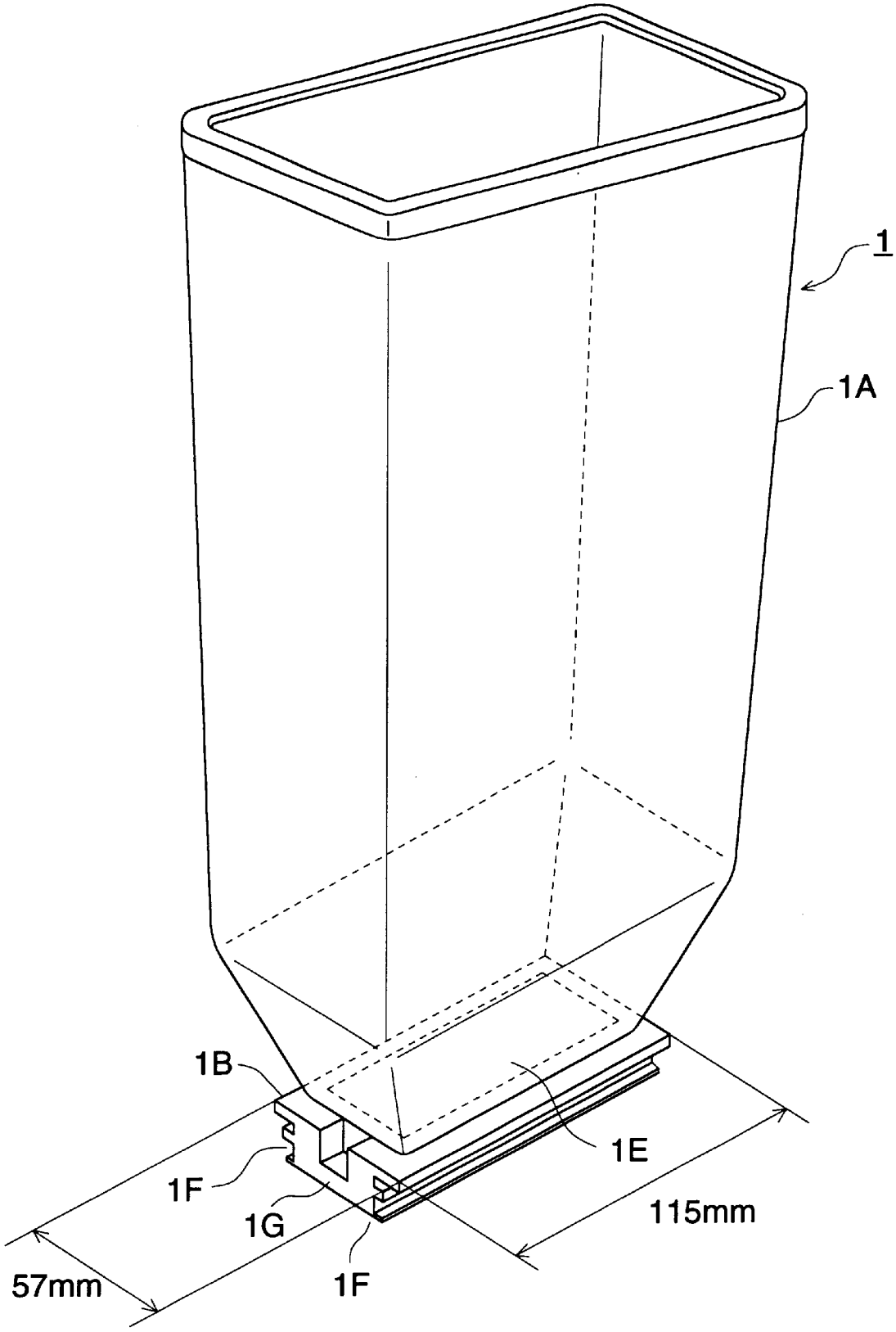

FIG. 1 is a perspective view of the toner cartridge of the present invention. FIG. 2 is a cross-sectional view of the same. FIG. 3 is a perspective view of the container of the toner cartridge.

The toner cartridge of the present invention is constructed mainly with:

A container body 1 consisting of a casing 1A, which stores powdery toner, and a mouthpiece 1B, connecting to the bottom portion of said casing 1A;

A capping member 2, which caps the opening on the top portion of said casing 1A;

a flexible sealing member 3, which shuts an opening in the bottom portion of the container body; and a slidable lid 4, which is arranged underneath said sealing member 3, and is freely slidably engaged with said container body 1.

Said container body 1 comprises a top opening portion and a bottom opening portion, and the neighborhood of said bottom opening portion of said container body 1 forms the shape of a box-type truncated pyramid and said mouthpiece 1B has been integrally molded in the bottom portion. The open portion in the bottom of the container body 1 and the open portion of the mouthpiece 1B forms a connected inner wall, forming an toner replenishing port section 1C. The outer wall of the circumference of said toner replenishing port section 1C forms a sealing surface 1D and the above-mentioned sealing member 3 is thermally fused on this surface so as to be peeled off.

One end portion of said sealing member 3 is fixed to the bottom surface of the flange portion 1E of the mouthpiece 1B and the other end portion to the upper surface of said flange portion 1E, respectively, and it is provided so as to wind up the slidable lid 4. Before the toner supplying, the slidable lid 4 is arranged in a position to protect and shield the sealing member 3 which seals the toner replenishing port section 1C.

In the above-mentioned mouthpiece 1B, in addition to the above-mentioned toner replenishing port section 1C, the flange portion 1E and stopping surface 1D, a guide rail member 1F, which makes the above-mentioned slidable lid 4 slidable, a mouthpiece 1B and a locking member 1G, which engages the toner receiving apparatus and is not shown in this drawing, are provided. That is to say, in the state prior to supply of the toner, said sealing member 3 is thermally fused to the stopping surface 1D to be freely peeled off and the open port 1C is sealed up.

The above-mentioned slidable lid 4 has a H-type cross-sectional shape and a flat board member in the center enables the open portion 1C of the mouthpiece 1B to open or shut. Concave-shaped grooves arranged on both sides above it interfit with the rail members 1F and 1F and, thus, making the slidable lid 4 slidable.

Casing 1A in the above-mentioned container body 1 and the mouthpiece 1B may either be prepared separately and, then be integrated, or they may be integrally formed from the beginning.

The above-mentioned container body 1, capping member 2 and the slidable lid 4 are produced by using a common resin material, and for recovery of the used toner cartridge, the segregating operation is eliminated so that recycling of raw materials is more efficiently achieved.

As for raw materials used for the flexible sealing member 3, for example, a plastic film material such as polyethylene, polyethylene terephthalate, polypropylene, polyvinyl chloride, polyvinylidene chloride, polycarbonate, nylon, etc. or metallic material such as an aluminum thin film, etc. can be used. These materials are used either singly, or in combination in the form of lamination. It is necessary for these materials to be a flexible material having adequate tensile strength, flexural strength, and a thickness. As one example of the above-mentioned sealing member 14, a film having a thickness of 75 $\mu$m formed by laminating polyethylene film having a thickness of 50 $\mu$m on polyethylene terephthalate film having a thickness of 25 $\mu$m was used.

Figure 5:
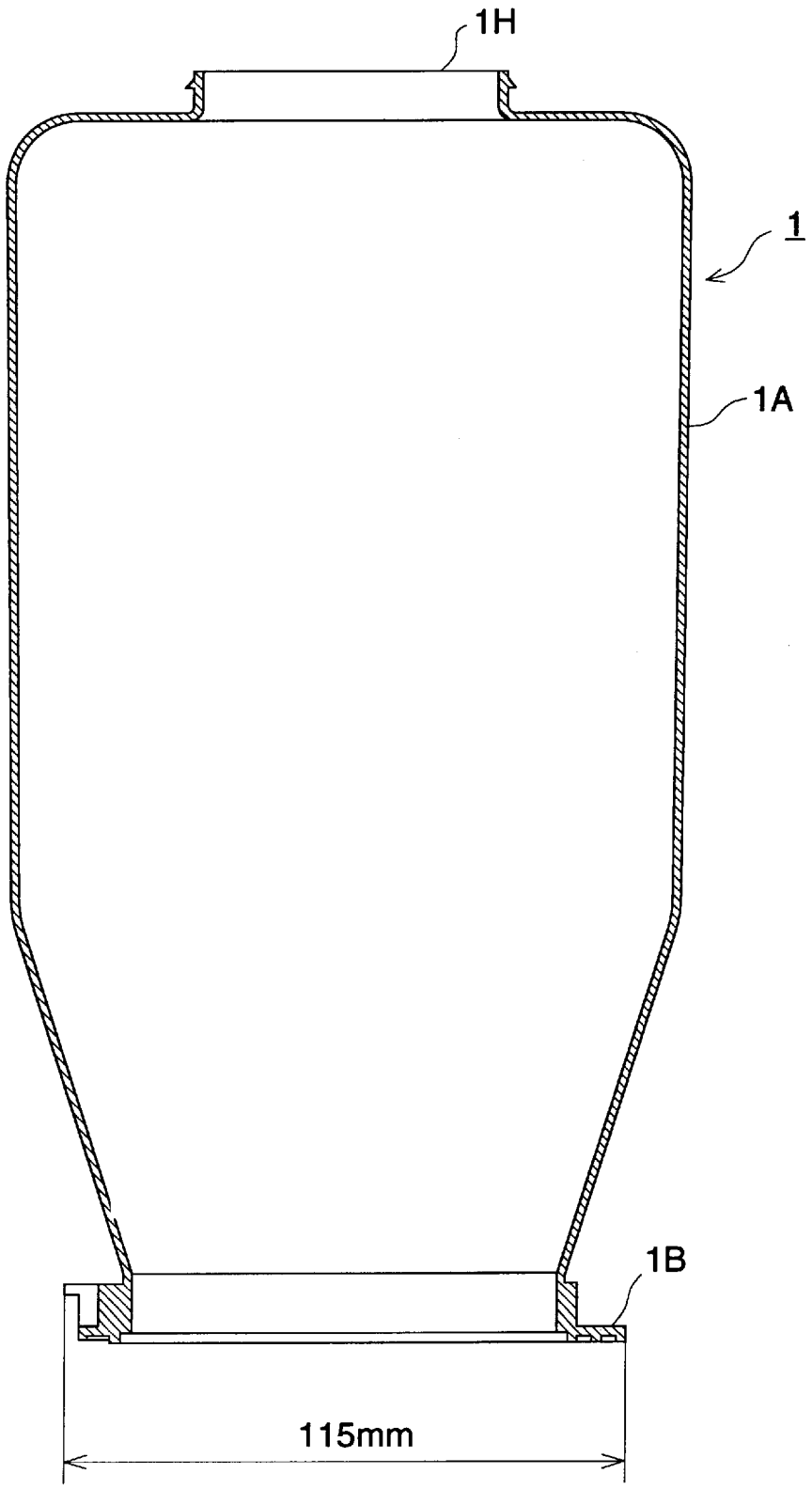

FIG. 4 is a perspective view showing the second embodiment of the toner cartridge of the present invention. FIG. 5 is a cross sectional view of the container body. Herein, the same marks as used in FIGS. 1–3 are used with respect to the parts having the same functions as those in FIGS. 1–3. In addition, only different features from those in the previous examples are explained as follows.

In FIG. 4(*a*), the container body 1A and the mouthpiece 1B are integrally formed and, then, a circular-shaped top opening portion 1H was provided in the top portion of said container body. After the toner is supplied to the container body 1 through said top opening portion 1H provided in the top portion thereof, the container was closed by the capping member 5 and sealed. The above-mentioned container body 1 comprising the above-mentioned container body 1A and the mouthpiece 1B can be integrally formed by hollow blow molding method(blow molding).

In FIG. 4(*b*), the container body 1A is formed by the hollow blow molding method and the mouthpiece 1B is formed by the injection molding method. In the bottom portion of the container body 1A , the mouthpiece 1B is inserted and fixed by adhesion.

Figure 7:
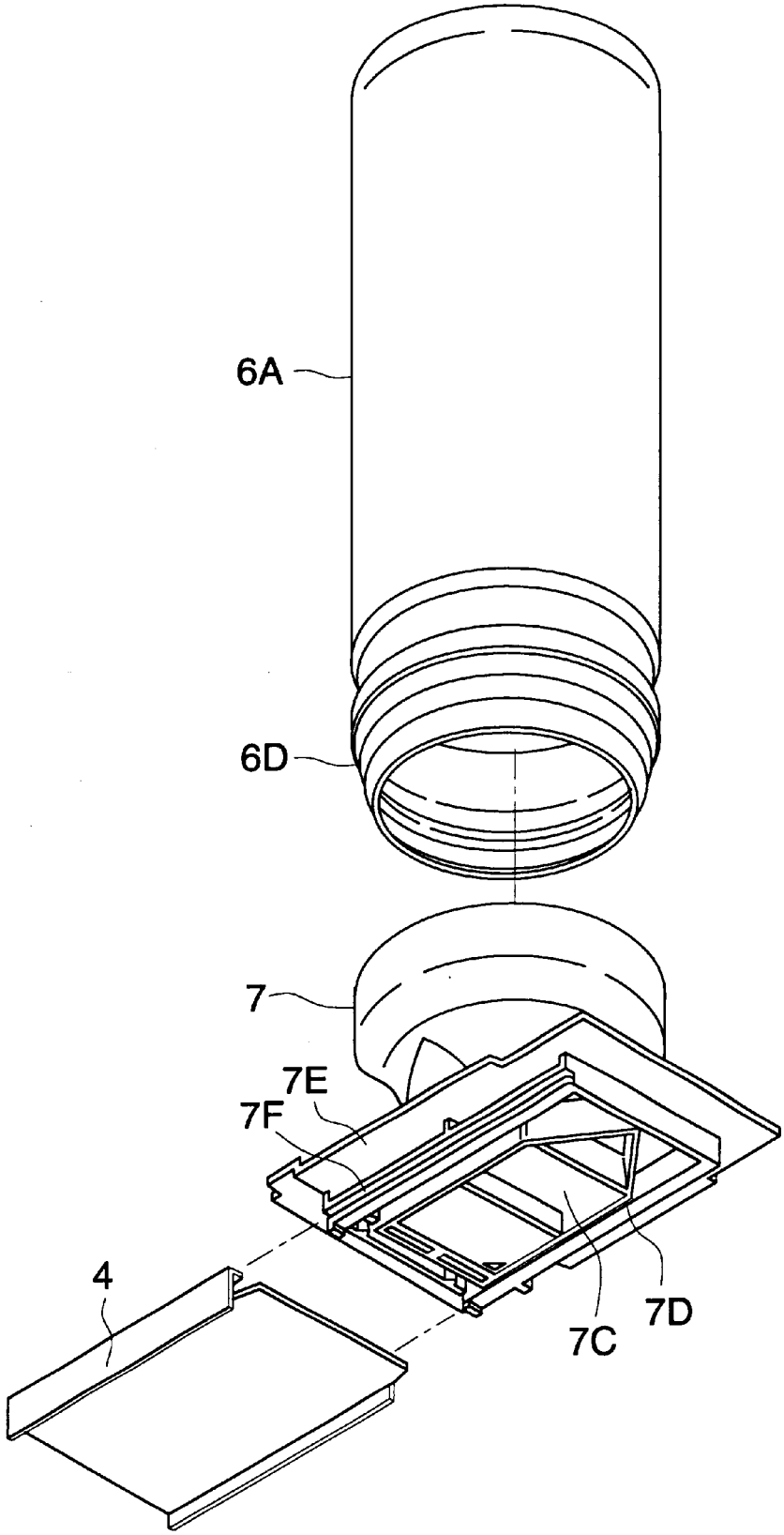

FIG. 6 shows the third embodiment of the toner cartridge of the present invention. FIG. 6(*a*) shows a perspective view of said cartridge; FIG. 6(*b*) a sectional view of the same cartridge; and FIG. 7 shows a perspective view of the same. Herein, the same marks as used in FIGS. 1–5 are used with respect to the parts having the same functions as those in FIGS. 1–5. In addition, only different features from those in the previous examples are explained as follows.

The container body 6 does not have the above-mentioned top opening portion 1H in the top portion thereof, but forms a ceiling portion 6B. In the bottom portion of said container body 6 shown in the drawing, there are provided toner replenishing port rection 6C inside and a coupling section 6D outside thereof. Said coupling section 6D is firmly integrated with the coupling receiving portion 7A of the mouthpiece 7. In the bottom portion of said mouthpiece 7 as shown in the drawing, there are provided a sealing surface 7D, a flange section 7E and guide rail member 7F. The flexible seal member 3, which has removably been adhered to the sealing surface 7D, closes the toner replenishing port section 7C. When toner is supplied, the flexible seal member 3 is peeled off by moving of the slidable lid 4 and the toner replenishing port section 7C is opened.

The above-mentioned container body 6 is formed by hollow blow molding method and the mouthpiece 7 is formed by an injection molding method. To this coupling section 6D of the bottom portion of the container body 6 in which the casing 6A and the mouthpiece are separately prepared, coupling receiving portion 7A of the coupling section 7 is inserted to be fixed. The coupling section 6D and the coupling receiving section 7A are integrated by tightening a screw, tightening fit or adhesive fixing.

Next, raw material used for the container body 1 and/or 6 of the toner supplying cartridge is explained in detail.

As to the manufacturing method of the toner cartridge, the compositions described in the above-mentioned can be mentioned and the body having the openings for filling-up the toner and for supplying the toner is produced by hollow blow molding method or injection molding method. Next, replenishing port is adhesived or tighted to opening portion for supplying toner then, toner is filled through the opening portion for supplying toner, and the opening portion is closed by a capping member such as a cap.

In the present invention, there is no specific limitation as to the thickness of the outer wall constituting the container body 1 or 6, however, in view of maintaining durability, the thickness of not less than 1.0 mm is preferable. Although there is no specific limitation as to the maximum thickness, the thickness of not more than 5.0 mm is preferable in the practical point of view.

In the case where an impact such as falling is applied to the container body 1 or 6, when the outer wall of the container body is uneven, the outer wall becomes fragile therefore, it is preferable that the fluctuation of the thickness is not more than 1.0 mm and, more preferably not more than 0.5 mm. Herein, this fluctuation of the thickness denotes the difference between the average thickness and the minimum thickness. In this case, the average thickness represents the average thickness value when randomly selected ten portions except elbow-shaped portion. Further, the minimum thickness denotes the minimum thickness value among these ten portions.

In the present invention, measurement of density is conducted according to JIS K-7112.

As to the method of measuring density, a method using a pycnometer is one of the most simplest methods. To be more specific, prepare a pycnometer which has thoroughly been cleaned and dried and measure precisely the weight of this. This is made as b (g). Next precisely fill this with a dipping solution to the reference line at 23° C.±0.1° C. and, then, precisely measure the weight of this. Next, empty the pycnometer and, after drying, injecting 1–5 g of a sample into the pycnometer and, once again, measure the weight of the pycnometer in the condition where the pycnometer is filled with the sample. Then, weight of the sample is obtained by subtracting the weight of dry pycnometer. This is made as a (g). Next, add the dipping solution to the pycnometer filled with the sample and put this into a desiccator under a condition where the sample is covered and, thus, remove the air containing in the dipping solution by decompression. Further, add the dipping solution, from which the air is removed, into the pycnometer to the reference line under a temperature condition at 23±0.1° C. and the weight is measured. This is made as c (g). From these results, objective density is obtained by the following formula.

$$\text{Density}=a\times d/(b-c+a)$$

Herein, d is density of the dipping solution at 23° C.

In the present invention, as for polyethylene of the present invention, high density polyethylene having a density of 0.94 to 0.97 g/cm$^3$ is preferably employed.

As for polypropylene of the present invention, it is preferable that the density of polypropylene is 0.90–0.91.

In the present invention, the Izod impact value is measured by the same method disclosed in JIS K7110 (definition and method of measurement of the Izod impact value of a hard plastic).

In the present invention, the melt-flow index is measured by the same method disclosed in JIS K7210 (definition and method of measurement of the melt-flow index).

In the present invention, melt-flow index values for polypropylene and polyethylene are ones measured under conditions of 230° C./2.16 kg and 190° C./2.16 kg, respectively.

EXAMPLE

The container body 1 for toner cartridge of the present invention was prepared by injection molding method and hollow blow molding method, respectively and evaluations were carried out by using ones having various physical properties. Evaluation was conducted by dropping tests.

The thickness of the outer wall of the container body 1 was made to be 1.5 mm. Using samples with various melt-flow indexes (MI) this thickness differences were evaluated. The container bodies for the toner supplying cartridge of FIGS. 1, 4(*a*) and 4(*b*) were prepared by the methods shown below:

(Products produced by injection molding method)

These products have each composition as shown in FIG. 1. A metal mold was adjusted so that the target thickness value may be 1.5 mm and these products were prepared by using polyethylenes or polypropylenes each having properties shown in the following Table 1. The maximum and the minimum thickness of the outer wall of the container body 1 were measured. Results are shown in Table 1.

TABLE 1

| No. | Resin No. | MI | Izod Impact Value | Density | Maximum Thickness | Minimum Thickness |
|---|---|---|---|---|---|---|
| Example 1 | PP-1 | 2.2 | 7.0 | 0.904 | 1.7 | 1.4 |
| Example 2 | PP-2 | 10.1 | 5.5 | 0.904 | 1.6 | 1.4 |
| Example 3 | PP-3 | 15.3 | 4.2 | 0.904 | 1.6 | 1.4 |
| Example 4 | PP-4 | 20.0 | 5.0 | 0.904 | 1.6 | 1.4 |
| Comparative Example 2 | PP-6 | 31.0 | 0.06 | 0.904 | 1.6 | 1.3 |
| Example 5 | PE-1 | 11.2 | 5.0 | 0.957 | 1.7 | 1.4 |
| Example 6 | PE-2 | 20.3 | 4.0 | 0.955 | 1.6 | 1.4 |
| Example 7 | PE-3 | 24.6 | 4.1 | 0.955 | 1.6 | 1.4 |
| Example 8 | PE-4 | 28.9 | 4.2 | 0.955 | 1.6 | 1.4 |
| Comparative Example 4 | PE-6 | 32.0 | 0.08 | 0.956 | 1.6 | 1.3 |

PP: Polypropylene
PE: Polyethylene (Products prepared by hollow blow molding method)

These products respectively have the composition as shown in FIGS. 4(*a*) and 4(*b*). Metal mold was adjusted so that the target thickness value may be 1.5 mm and the products were manufactured using polyethylene or polypropylene each having physical properties as shown in Table 2. The maximum and the minimum thickness of the outer wall of the cartridges obtained by the hollow blow molding are shown in Table 2.

TABLE 2

| No. | Resin No. | MI | Izod Impact Value | Density | Maximum Thick-ness | Minimum Thick-ness |
|---|---|---|---|---|---|---|
| Example 9 | PP-7 | 2.8 | 5.0 | 0.904 | 1.6 | 1.4 |
| Example 10 | PP-8 | 1.3 | 4.5 | 0.904 | 1.6 | 1.4 |
| Example 11 | PP-9 | 1.0 | 4.5 | 0.904 | 1.6 | 1.4 |
| Example 12 | PP-10 | 0.8 | 5.2 | 0.904 | 1.6 | 1.4 |
| Comparative Example 5 | PP-11 | 0.04 | 32.1 | 0.904 | 2.1 | 1.1 |
| Comparative Example 6 | PP-12 | 5.3 | 3.7 | 0.904 | 1.9 | 1.1 |
| Example 13 | PE-8 | 0.4 | 15.2 | 0.955 | 1.6 | 1.4 |
| Example 14 | PE-9 | 0.2 | 20.4 | 0.961 | 1.6 | 1.4 |
| Example 15 | PE-10 | 0.2 | 21.1 | 0.961 | 1.6 | 1.4 |
| Example 16 | PE-11 | 0.1 | 27.8 | 0.947 | 1.7 | 1.4 |
| Comparative Example 7 | PE-12 | 0.03 | 35.1 | 0.955 | 1.9 | 1.0 |
| Comparative Example 8 | PE-6 | 4.2 | 4.1 | 0.955 | 2.1 | 1.3 |

Evaluation

Toner supplying cartridges prepared as above were filled up with toner. The toner is prepared using a styrene-acryl type resin, and the toner comprises 6% by weight of carbon black, 3% by weight of low molecular weight polypropylene. Further, the toner comprises 0.8% by weight of silica having hydrophobicity as an external agent and has the volume average particle diameter of 8.6 $\mu$m. The cartridge was filled up with 470 g of this toner. Herein, in the above-mentioned container body 1 prepared by injection molding method, the bottom portion thereof was sealed using heat sealing and, further, the bottom portion is welded by using a capping member 2 formed by polypropylene. Further in the above-mentioned container body 1 prepared by hollow blow molding method, the bottom portion is tighted by using a capping member 2 formed by polyethylene and the bottom portion was sealed by heat sealing.

These toner cartridges filled up with toner were dropped from a position at 150 cm in height onto a floor made of concrete and the extent of damage was investigated. In addition, in order to evaluate stability during transport, ten of these toner cartridges were piled up and were left alone for 14 days under conditions at 50° C. and 80% R. H., and, then, degree of deformation was evaluated by visual observation. Results are shown in Table 3. In the dropping test of the present invention, a flat concrete floor, which is popularly used in the office is used.

Products prepared by injection molding method

TABLE 3

| No. | Result of Dropping Test | Extent of Deformation after Leaving |
|---|---|---|
| Example 1 | No damage | No deformed |
| Example 2 | No damage | No deformed |
| Example 3 | No damage | No deformed |
| Example 4 | No damage | No deformed |
| Comparison 2 | Damage Caused | Deformed and unusable |
| Example 5 | No damage | No deformed |
| Example 6 | No damage | No deformed |
| Example 7 | No damage | No deformed |
| Example 8 | No damage | No deformed |
| Comparison 4 | Damage Caused | Deformed and unusable |

Products prepared by hollow blow molding method

TABLE 4

| No. | Result of Dropping Test | Extent of Deformation after Leaving |
|---|---|---|
| Example 9 | No damage | No deformed |
| Example 10 | No damage | No deformed |
| Example 11 | No damage | No deformed |
| Example 12 | No damage | No deformed |
| Comparison 5 | Damage Caused | No deformed |
| Comparison 6 | Damage Caused | Deformed and unusable |
| Example 13 | No damage | No deformed |
| Example 14 | No damage | No deformed |
| Example 15 | No damage | No deformed |
| Example 16 | No damage | No deformed |
| Comparions 7 | Damage Caused | No deformed |
| Comparison 8 | Damage Caused | Deformed and unusable |

From the results shown above, it is understood that the toner cartridges, in which resins of the present invention are used, can be used with stability, without causing damages by impact such as due to dropping and without causing deformation after long period of storage.

What is claimed is:

1. A toner cartridge comprising:

a container body for storing toner having an opening for discharging stored toner, and a sealing member for sealing said opening when said toner is charged in said body, wherein said body is made from a single resin consisting of either a polyethylene resin or a polypropylene resin, each said resin having an Izod impact value of 0.1 to 30, and a melt flow index of 0.1 to 4 g/10 min.

2. The toner cartridge of claim 1 wherein said body comprises a casing having an outer wall with a thickness of 1 to 5 mm.

3. The toner cartridge of claim 1 wherein said body comprises a casing and a mouth piece, and said opening is in said mouth piece.

4. The toner cartridge of claim 1 wherein said sealing member is a plastic film.

5. The toner cartridge of claim 1 wherein said resin is polyethylene having a density of 0.94 to 0.97.

6. The toner cartridge of claim 1 wherein said resin is polypropylene having a density of 0.90 to 0.91.

7. The toner cartridge of claim 3 wherein said opening in said mouth piece is sealed by said sealing member.

8. The toner cartridge of claim 3 wherein said mouth piece is made of resin.

9. A toner cartridge comprising:

a container body for storing toner therein, said container body comprising a casing and a mouth piece, said mouth piece having an opening therein for discharging said stored toner therethrough;

a sealing member for sealing said opening when said toner is charged to said container body; and each of said casing and said mouth piece is made from a single resin consisting of either a polyethylene resin or a polypropylene resin, each said resin having an Izod impact value of 0.1 to 30 and a melt flow index of 0.1 to 4 g/10 min.

10. The toner cartridge of claim 9 wherein said casing has an outer wall with a thickness of 1 to 5 mm.

11. The toner cartridge of claim 9 wherein said sealing member is a plastic film.

12. A toner cartridge comprising:

a container body for storing toner therein, said container body comprising a casing with an outer wall thickness of 1 to 5 mm and a mouth piece, said mouth piece having an opening therein for discharging said stored toner therethrough;

a sealing member for sealing said opening when said toner is charged to said container body, said sealing member being a plastic film; and said container body is produced by a hollow blow molding method, said casing and said mouth piece is made from a single resin consisting of a polyethylene resin having an Izod impact value of 0.1 to 30, a density of 0.94 to 0.97, and a melt flow index of 0.1 to 4 g/10 min.

13. The toner cartridge of claim 1 wherein the body is produced by a hollow blow molding method.

14. The toner cartridge of claim 9 wherein both the casing and the mouth piece are made from the same resin consisting of either said polypropylene resin or said polyethylene resin.

* * * * *